US005910703A

United States Patent [19]

Kuo et al.

[11] Patent Number: 5,910,703

[45] Date of Patent: Jun. 8, 1999

[54] HIGH VOLTAGE SPACER FOR A FLAT PANEL DISPLAY WITH SPECIFIC CROSS SECTION

[75] Inventors: Huei-Pei Kuo, Cupertino; Richard R. Baldwin, Saratoga, both of Calif.

[73] Assignee: Hewlett-Packard Company, Palo Alto, Calif.

[21] Appl. No.: 08/690,668

[22] Filed: Jul. 31, 1996

[51] Int. Cl.[6] ..... H01J 31/00

[52] U.S. Cl. ..... 313/482; 313/496; 313/495; 445/24

[58] Field of Search ..... 313/233, 268, 313/292, 309, 310, 422, 425; 174/138 D, 138 J, 138 G, 138 R, 139, 158 R, 209

[56] References Cited

U.S. PATENT DOCUMENTS

| | | | |
|---|---|---|---|
| 3,753,022 | 8/1973 | Farzer, Jr. | 313/78 |
| 3,910,536 | 10/1975 | Sharp et al. | 174/138 |
| 5,561,343 | 10/1996 | Lowe | 313/482 |
| 5,587,623 | 12/1996 | Jones | 313/497 |
| 5,589,728 | 12/1996 | Levine et al. | 313/336 |
| 5,734,224 | 3/1998 | Tagawa et al. | 313/493 |

FOREIGN PATENT DOCUMENTS

| | | | |
|---|---|---|---|
| A10311184 | 9/1988 | European Pat. Off. | H01J 29/74 |
| A2 0404022 | 6/1990 | European Pat. Off. | H01J 31/12 |
| 0614209A1 | 2/1994 | European Pat. Off. | H01J 31/12 |
| 0645794A1 | 9/1994 | European Pat. Off. | H01J 21/20 |

*Primary Examiner*—Sandra O'Shea
*Assistant Examiner*—Matthew J. Gerike

[57] ABSTRACT

The invention is a spacer method and apparatus for a high-voltage emissive vacuum flat panel display device. The display device has front and rear panels held in place by a supporting frame around the periphery of the panels. The back panel has an array of electron sources that accelerate electrons towards the front panel to bombard and excite a light-emissive material deposited thereon, thereby modulating the screen and displaying desired information patterns. A spacer according to the present invention can be described generally as having a body and N arms extending radially from the body, wherein N is at least three. The body and the N arms physically contact the front and back panels of the display to thereby separate the front panel from the back panel. The arms need not have the same length of extension from the body. Furthermore, the arms may or may not taper as they extend from the body. Such a spacer has a high compressive stress resistance, does not buckle easily, is easy to make invisible, is easy to fabricate and to assemble into the display device.

17 Claims, 4 Drawing Sheets

HIGH VOLTAGE SPACER FOR A FLAT PANEL DISPLAY WITH SPECIFIC CROSS SECTION

BACKGROUND OF THE INVENTION

1. Field of the Invention

The present invention relates to flat panel display devices and, more particularly, to spacers for a high voltage flat panel display.

2. Description of the Related Art

An emissive vacuum flat-panel display typically has front and rear panels held in place by a supporting frame around the periphery of the panels. Examples of flat panel displays can be found in European Patent Application number 94301384.7, entitled "A Flat Panel Display", published Sep. 7, 1994, and in European Patent Application number 94306859.3, entitled "Focusing and Steering Electrodes for Electron Sources", published Mar. 29, 1995, both having the same inventor, Huei Pei Kuo.

A thin layer of light-emissive material such as phosphor is typically deposited on the front panel of the display. The phosphor emits visible light when bombarded by energetic electrons. The back panel of the display, in turn, has an array of electron sources. The electron sources accelerate electrons towards the front panel to bombard and excite the phosphor material on the front panel. When appropriate signals are applied to the electron-source array and the phosphor screen, light emitted from the phosphor screen is modulated to display desired information patterns. If an array of field emission electron source is used as the electron sources, such a display is commonly known as a Field Emission Display ("FED").

The front and back panels of a vacuum flat-panel display are typically made of transparent glass of a thickness of approximately 1 mm. The supporting frame around the periphery is used to maintain a distance of a few millimeters between the panels. The panels and the frame form a vacuum envelope which is evacuated to a vacuum better than approximately $10^{-7}$ Torr. This causes the panels to be subjected to an atmospheric pressure of approximately 1 $Kg/cm^2$. For a display with a screen dimension greater than approximately 1 cm by 1 cm, additional support structures, or spacers are required to prevent the panels from being distorted or destroyed under the atmospheric pressure.

Basically, three types of spacer designs are used by the prior art: spheres, cylinders and walls. Although each design has one or more advantage, inherent to each design is one or more undesirable disadvantage.

Spherical spacers are ideally shaped to withstand compressive stress; are easy to manufacture and displays using spherical spacers are easy to assemble. However, because the size of sphere equals the spacing between the panels, the sphere becomes visible when the panel spacing is greater than 200–300 $\mu$m.

Cylindrical post spacers have an excellent compressive strength. They also have a small lateral dimension, therefore the posts remain invisible for larger spacing between the panels than is possible in the case of spherical spacers. Cylindrical posts have poor buckling strength, however, and displays using cylindrical posts can be difficult to assemble.

Finally, wall spacers have an excellent stiffness in the direction along wall and are easily fabricated. On the other hand, wall spacers have a poor buckling strength in the direction perpendicular to the wall; displays using wall spacers are difficult to assemble; and the wall spacers are difficult to make invisible.

In a field emission display where high-voltage phosphor is used, the minimum spacing between the front and rear panel is approximately 1 mm for a 5 Kilovolt operation. The spherical spacer is too large and not suitable for this application. The cylindrical and wall spacers can be used, but suffer from the shortcomings listed above.

Thus, it can be seen that the poor strength, visibility and assembly difficulty limits of current technology spacers for flat-panel display devices limits the use of these devices in many applications.

Therefore, there is an unresolved need for a spacer for a high-voltage flat panel display that will significantly improve the strength, invisibility and assembly limits of current technology spacers.

SUMMARY OF THE INVENTION

The invention is a spacer method and apparatus for a high-voltage emissive vacuum flat panel display device. The display device has front and rear panels held in place by a supporting frame around the periphery of the panels. The back panel has an array of electron sources that accelerate electrons towards the front panel to bombard and excite a light-emissive material deposited thereon, thereby modulating the screen and displaying desired information patterns.

A spacer according to the present invention can be described generally as having a body and N arms extending radially from the body, wherein N is at least three. The body and the N arms physically contact front and back panels of a flat-panel display to thereby separate the front panel from the back panel. The arms need not have the same length of extension from the body. Furthermore, the arms may or may not taper as they extend from the body.

Such a spacer has a high compressive stress resistance, does not buckle easily, is easy to make invisible, is easy to fabricate and to assemble into the display device.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION OF THE INVENTION

Embodiments of the invention are discussed below with reference to FIGS. 1–7. Those skilled in the art will readily appreciate that the detailed description given herein with respect to these figures is for explanatory purposes, however, because the invention extends beyond these limited embodiments.

Figure 1:
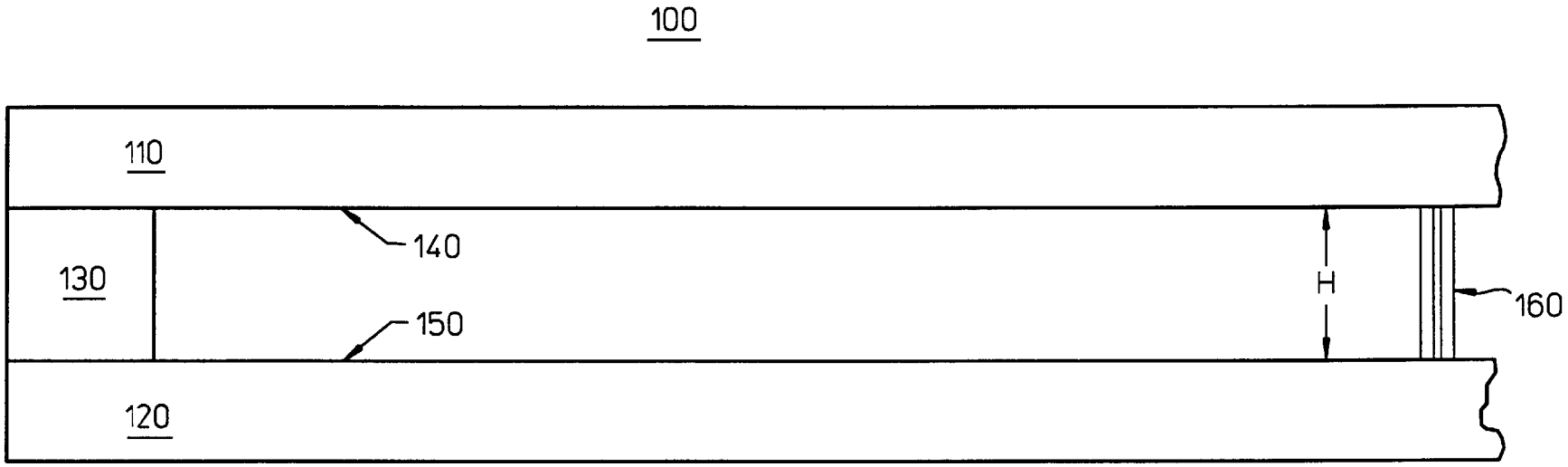
FIG. 1 is a cut-away view of a flat-panel display device employing a spacer constructed according to the present invention.

FIG. 1 is a cut-away view of a flat-panel display device employing a spacer constructed according to the present invention. FIG. 1 shows an emissive vacuum flat-panel display 100 having respective front and rear panels 110 and 120 held in place by a supporting frame 130 around the periphery of the panels. A thin layer of light-emissive material 140 such as phosphor is deposited on the front panel 110 of the display 100. The phosphor emits visible light when bombarded by energetic electrons. The back panel 120 of the display, in turn, has an array of electron sources 150. The electron sources accelerate electrons towards the front panel 110 to bombard and excite the phosphor material 140 on the front panel. When appropriate signals are applied to the electron-source array 110 and the phosphor screen 140, light emitted from the phosphor screen 140 is modulated to display desired information patterns.

The panels 110 and 120 of vacuum flat-panel display 100 are typically made of transparent glass of a thickness of approximately 1 mm. The supporting frame 130 around the periphery is used to maintain a distance of a few millimeters between the panels. The panels and the frame form a vacuum envelope which is evacuated to a vacuum better than approximately $10^{-7}$ Torr. This causes the panels 110 and 120 to be subjected to an atmospheric pressure of approximately 1 Kg/cm$^2$. For a display 100 with a screen dimension greater than approximately 1 cm by 1 cm, additional support structures, such as spacer 160, are required to prevent the panels 110 and 120 from being distorted or destroyed under the atmospheric pressure.

In a field emission display 100 where high-voltage phosphor is used, the minimum spacing between the front panel 110 and the rear panel 120 is approximately 1 mm for a 5 Kilovolt operation. Thus, in FIG. 1 a side view of a cross-shaped spacer 160 embodiment constructed according to the present invention is shown. For one embodiment the height H of the spacer 160 is 1 mm. Because spacer 160 physically contacts and separates panels 110 and 120, it follows that the height of spacer 160 is the same as the desired separation between front panel 110 and rear panel 120.

Spacer 160 can be made by drawing glass as is well known in the art of glass fiber manufacture. For one embodiment, spacer 160 is treated to make the spacer slightly conductive. Typically, as is known in the art, either a thin coating of conductive material is deposited on a spacer, or a conductive "doping" agent is included in the glass of the spacer. This slight conductivity permits electrons from electron source 150 to drain from the spacer 160. For an embodiment wherein spacer 160 is not made slightly conductive, electrons can accumulate on the spacer 160. These accumulated electrons can create charge that deflects the beam to distort the image being displayed on the screen. In the worst case, an electron accumulation can create a catastrophic discharge.

Figure 2:
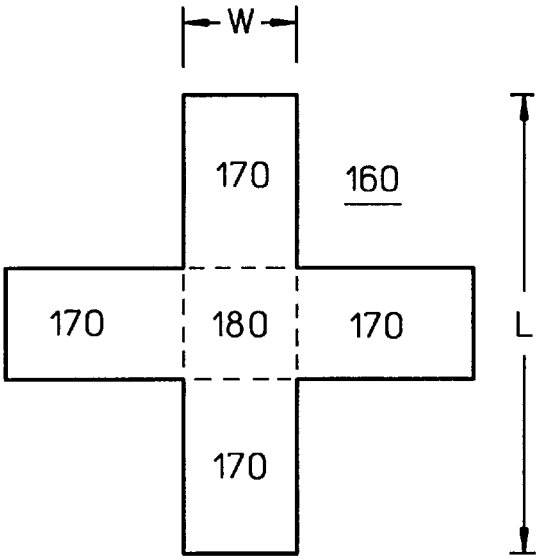
FIG. 2 is a top view of a spacer of the type represented in FIG. 1 wherein four arms extend radially from a central body to form a cross pin.

FIG. 2 is a top view of the cross-shaped spacer 160 represented in FIG. 1 wherein four arms 170 extend radially from a central body 180 to form a cross pin. For one cross pin embodiment, spacer 160 is a glass column wherein the end-to-end length L of the arms 170 is 0.3 mm and the width W of the arms 170 is 0.07 mm. For this embodiment, the height of the spacer 160 is 1 mm.

Figure 3:
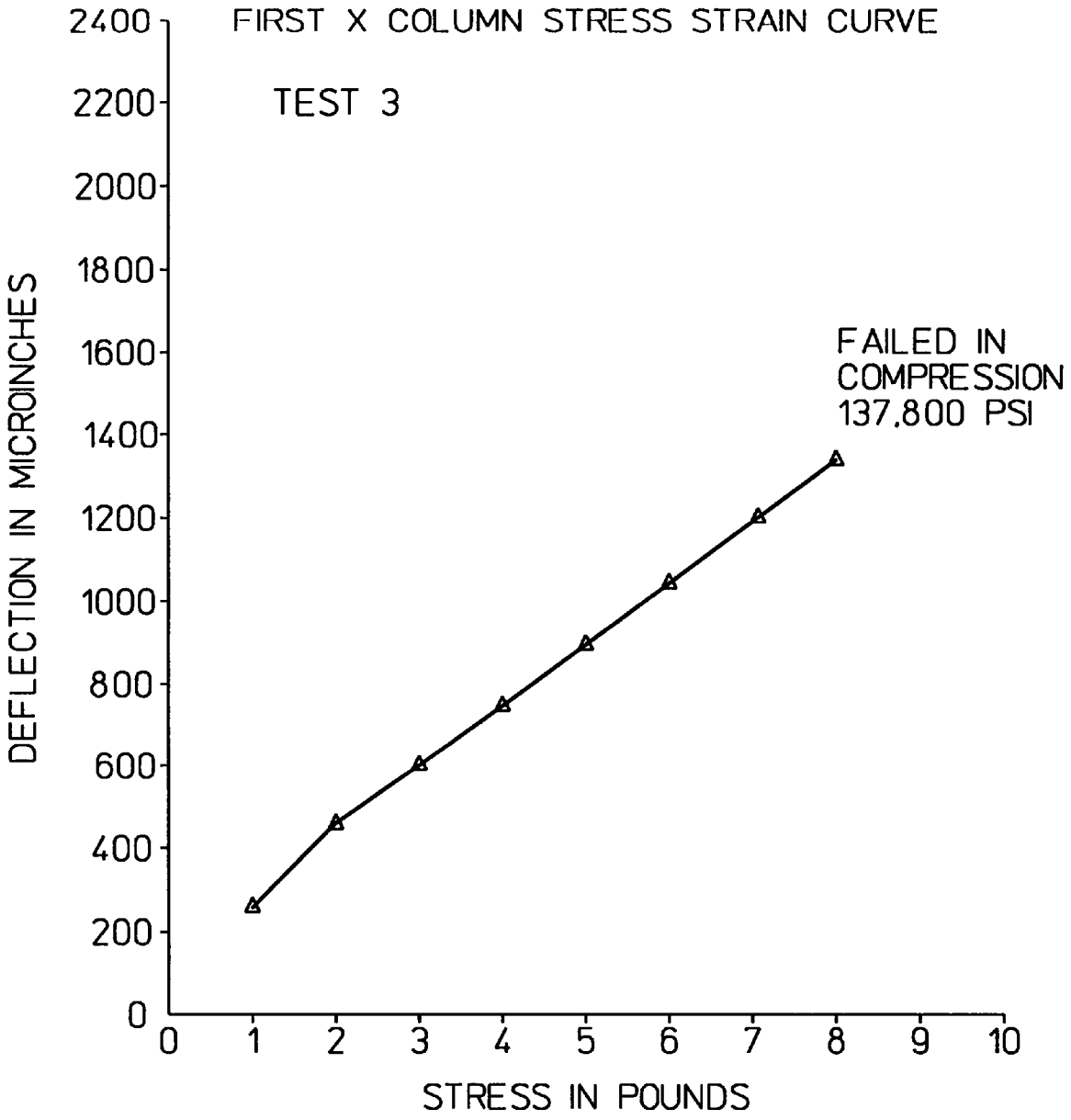
FIG. 3 is a column stress strain curve for an embodiment of the spacer illustrated in FIG. 2.

Cross pin spacers 160 have been fabricated according to this embodiment and the compressive strength of the spacer 160 has been tested. A typical experimental result is shown in FIG. 3. Thus, FIG. 3 is a column stress strain curve for an embodiment of the spacer 160 illustrated in FIGS. 1 and 2. As can be seen in FIG. 3, it took more than 3.6 Kg, approximately 9850 Kg/cm$^2$, before the spacer 160 failed. The cross pins 160 failed, not from excessive compressive force, but by failure from the testing equipment. In the experiment the cross pin 160 under test was held by a pair of jaws, one on the top and one on the bottom of the spacer 160. In such a test, if the surfaces of the jaws are not perfectly parallel to each other, or if the cross pin 160 under test is not positioned perpendicular to the surface of each of the jaws, there is a tendency to eject the cross pin 160 from between the jaws when the applied pressure increases.

Thus, the tested results indicate a lower limit on the compressive strength of the cross pin 160. If the tested value is taken as the strength of the cross pin 160, one spacer approximately every 1.27 cm is sufficient to support the panels 110. Therefore, the spacing between the spacers 160 will be determined by the strength of the panel 110 and 120 glass rather than the compressive strength of the spacers 160.

Prior testing with a round-post (i.e., cylindrical column) spacer having a 0.1 mm diameter and a 1.0 mm height indicated that the round-post spacers failed by buckling at a force less than 0.4 Kg. Accordingly, it would require approximately 10 times more round posts to support the panels, than are required when using the cross pin spacers. Table 1 shows a comparison of the buckling strength between the round post and cross pin spacers.

TABLE 1

| SHAPE | AREA CM$^2$ | MOMENT CM$^4$ | COMPRESSION AT BUCKLING MICRON | FORCE AT BUCKLING KG |
|---|---|---|---|---|
| Round | $8.13 \times 10^{-5}$ | $0.53 \times 10^{-9}$ | 1.27 | 0.07 |
| Cross | $38 \times 10^{-5}$ | $16.5 \times 10^{-9}$ | 8.4 | 2.2 |

With the dimensions shown in Table 1, the buckling strength of the cross pin spacers is 30 times higher than the round post spacers. Moreover, the cross pin spacers were able to withstand a compression before buckling that was more than six times greater than that of the round pin. The improved compressibility of the cross pin spacers is significant because it is desirable to have supports that can withstand a fairly large amount of deflection before buckling. This is because in a practical display the tolerances between the panels are such that some supports will receive higher compressive forces than others. The improved compressibility of the cross pin spacers will permit the supports receiving the higher compressive forces to deflect rather than fail by buckling.

The sizes of the arms 160 can be extended much beyond that shown. For example, to provide for ease of assembly, it is desirable to extend the length of the arms 170 to equal or greater than the height of the cross pin 160 to make assembly easier.

Many alternate embodiments of spacer 160 are illustrated in FIGS. 4–8 wherein each figure is selected to demonstrate a different parameter that can be varied when constructing a spacer according to the present invention.

Figure 4:
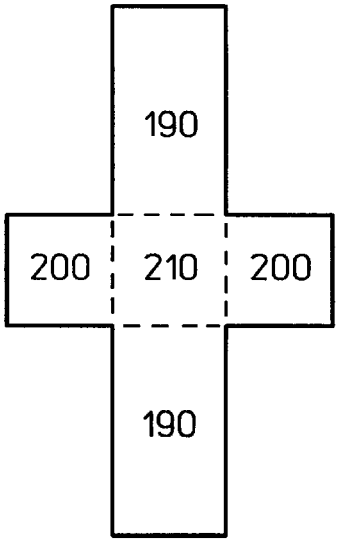
FIG. 4 is a top view of an alternate embodiment cross pin spacer wherein one set of arms extend a greater radial distance from the body than another set.

FIG. 4 is a top view of an alternate embodiment cross pin spacer wherein one set of arms 190 extend a greater radial distance from the body 210 than another set of arms 200.

Figure 5:
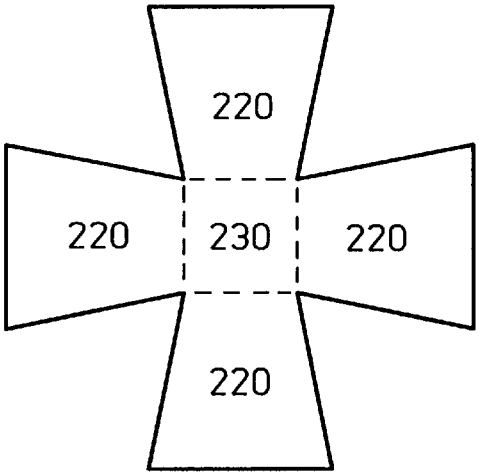
FIG. 5 is a top view of an alternate embodiment cross pin spacer wherein the arms taper out as they extend radially from the body.

FIG. 5 is a top view of an alternate embodiment cross pin spacer wherein the arms 220 taper out as they extend radially from the body 230.

Figure 6:
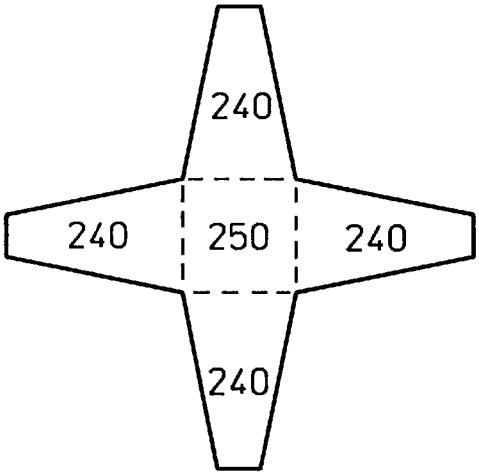
FIG. 6 is a top view of an alternate embodiment cross pin spacer wherein the arms taper in as they extend radially from the body.

FIG. 6 is a top view of an alternate embodiment cross pin spacer wherein the arms 240 taper in as they extend radially from the body 250.

Figure 7:
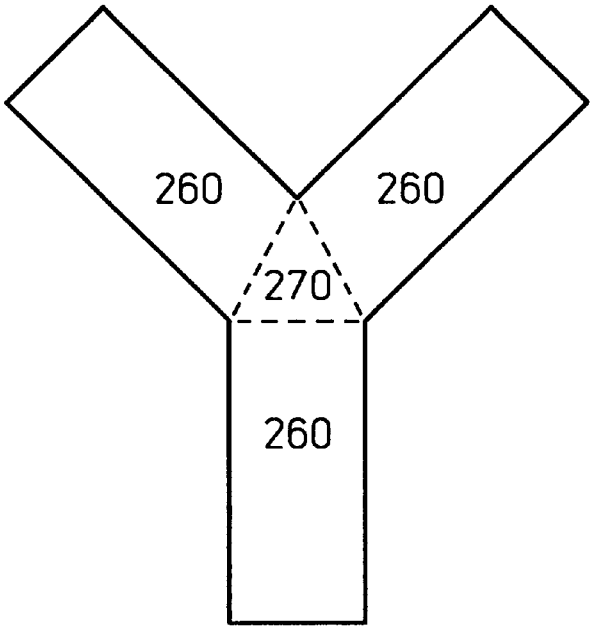
FIG. 7 is a top view of an alternate embodiment spacer wherein three arms extend radially from a central body to form a y-shaped pin.

FIG. 7 is a top view of an alternate embodiment spacer wherein three arms 260 extend radially from a central body 270 to form a y-shaped pin.

Figure 8:
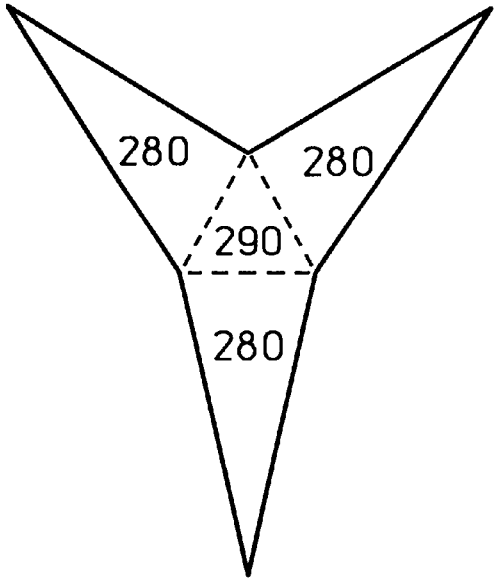
FIG. 8 is a top view of an alternate embodiment y-shaped pin spacer wherein the arms taper in to a point as they extend radially from the body.

FIG. 8 is a top view of an alternate embodiment y-shaped pin spacer wherein three arms 280 taper in to a point as they extend radially from body 290.

Thus, it can be seen that many possible embodiments of the spacer are possible. Generally, a spacer according to the present invention can be described as having a body and N arms extending radially from the body, wherein N is at least three. The body and the N arms physically contact front and back panels of a flat-panel display to thereby separate the front panel from the back panel. The arms need not have the same length of extension from the body. Furthermore, the arms may or may not taper as they extend from the body.

The many features and advantages of the invention are apparent from the written description and thus it is intended by the appended claims to cover all such features and advantages of the invention. Further, because numerous modifications and changes will readily occur to those skilled in the art, it is not desired to limit the invention to the exact construction and operation as illustrated and described. Hence, all suitable modifications and equivalents may be resorted to as falling within the scope of the invention.

What is claimed is:

1. A spacer for a flat-panel display, the flat-panel display having a front and back panel, the spacer comprising:

a body; and

N arms extending radially from the body, wherein N is at least three and the body and the N arms physically contact the front and back panels to thereby separate the front panel from the back panel, the spacer being formed by drawing, and wherein at least one of the N arms extends farther in the radial direction from the body than at least one other of the N arms.

2. The spacer as set forth in 1, wherein N is four and the N arms intersect at the body to form a cross.

3. The spacer as set forth in 1, wherein at least one of the N arms tapers in the radial direction from the body.

4. A spacing method for a flat-panel display, the flat-panel display having a front and back panel, the spacing method comprising the steps of:

physically contacting a spacer to the front panel, the spacer having a body and N arms extending radially from the body, with N being at least three, the spacer being formed by drawing, and wherein at least one of the N arms extends farther in the radial direction from the body than at least one other of the N arms; and physically contacting the spacer to the back panel such that the body and the N arms physically contact the front and back panels to thereby separate the front panel from the back panel.

5. The spacing method as set forth in 4, wherein N is four and the N arms intersect at the body to form a cross.

6. The spacing method as set forth in 4, wherein at least one of the N arms tapers in the radial direction from the body.

7. A flat-panel display comprising:

a front panel;

a back panel; and a spacer having a body and N arms extending radially from the body, the spacer being formed by drawing, wherein N is at least three and the body and the N arms physically contact the front and back panels to thereby separate the front panel from the back panel, and wherein at least one of the N arms of the spacer extends farther in the radial direction from the body than at least one other of the N arms.

8. The flat-panel as set forth in 7, wherein N is four and the N arms of the spacer intersect at the body to form a cross.

9. The flat-panel display as set forth in 7, wherein at least one of the N arms of the spacer tapers in the radial direction from the body.

10. The flat-panel display as set forth in 7, wherein the front panel is a display panel.

11. The flat-panel display as set forth in 7, wherein the front panel has a layer of light emissive material.

12. The flat-panel display as set forth in 7, wherein the front panel has a layer of phosphor.

13. The flat-panel display as set forth in 7, wherein the back panel has an array of electron sources.

14. The flat-panel display as set forth in 7, wherein the back panel has an array of field emission electron source.

15. The flat-panel display as set forth in 7, wherein the front panel has a layer of light emissive material and the back panel has an array of electron sources.

16. The flat-panel display as set forth in 7, wherein the spacer is formed by drawing glass.

17. The spacer as set forth in 1, wherein the spacer is formed by drawning glass.

* * * * *